US009227106B2

(12) United States Patent
Richards

(10) Patent No.: US 9,227,106 B2
(45) Date of Patent: Jan. 5, 2016

(54) WEIGHT LIFTING MACHINE

(71) Applicant: Todd Richards, Rochester, NY (US)

(72) Inventor: Todd Richards, Rochester, NY (US)

( * ) Notice: Subject to any disclaimer, the term of this patent is extended or adjusted under 35 U.S.C. 154(b) by 280 days.

(21) Appl. No.: 13/899,106

(22) Filed: May 21, 2013

(65) Prior Publication Data

US 2013/0331239 A1 Dec. 12, 2013

Related U.S. Application Data

(60) Provisional application No. 61/649,682, filed on May 21, 2012.

(51) Int. Cl.

| | |
|---|---|
| ***A63B 21/062*** | (2006.01) |
| ***A63B 23/04*** | (2006.01) |
| ***A63B 21/00*** | (2006.01) |
| ***A63B 21/06*** | (2006.01) |
| ***A63B 23/035*** | (2006.01) |

(52) U.S. Cl.

CPC ..... *A63B 23/0405* (2013.01); *A63B 21/00069* (2013.01); *A63B 21/00192* (2013.01); *A63B 21/0611* (2013.01); *A63B 21/1465* (2013.01); *A63B 23/03525* (2013.01); *A63B 21/062* (2013.01); *A63B 2021/0612* (2013.01)

(58) Field of Classification Search

CPC ..... A63B 21/06; A63B 21/0611; A63B 21/0613; A63B 21/062; A63B 21/1465; A63B 21/1488; A63B 22/0023; A63B 23/0405; A63B 23/0417; A63B 23/0429; A63B 23/0494; A63B 2021/0612; A63B 2021/0614; A63B 2023/0411; A63B 2023/0441; A63B 2023/0447; A63B 2023/0452

USPC ..... 482/51, 72, 93–103, 133–138, 142

See application file for complete search history.

(56) References Cited

U.S. PATENT DOCUMENTS

| | | | | |
|---|---|---|---|---|
| 4,176,836 | A * | 12/1979 | Coyle | 482/96 |
| 5,456,648 | A * | 10/1995 | Edinburg et al. | 482/4 |
| 5,827,154 | A * | 10/1998 | Gill | 482/9 |
| 5,967,955 | A * | 10/1999 | Westfall et al. | 482/142 |
| 6,685,600 | B1 * | 2/2004 | Ullman | 482/103 |
| 7,004,891 | B2 * | 2/2006 | Morris et al. | 482/101 |
| 7,115,080 | B2 * | 10/2006 | Cockrill et al. | 482/138 |
| D606,135 | S * | 12/2009 | Grider | D21/694 |
| 7,744,506 | B2 * | 6/2010 | Blaylock | 482/51 |
| 8,834,332 | B2 * | 9/2014 | Campanaro et al. | 482/142 |
| 2005/0159278 | A1 * | 7/2005 | McVay et al. | 482/142 |
| 2005/0272571 | A1 * | 12/2005 | Moring et al. | 482/93 |
| 2008/0161173 | A1 * | 7/2008 | Campanaro et al. | 482/133 |

* cited by examiner

*Primary Examiner* — Loan H Thanh
*Assistant Examiner* — Gregory Winter
(74) *Attorney, Agent, or Firm* — Woods Oviatt Gilman LLP; Katherine H. McGuire, Esq.

(57) ABSTRACT

Weight lifting machines and methods are described including angularly adjustable leg press units and hack squat units whereby the user may quickly change between any desired angular orientation of the units relative to the floor.

1 Claim, 22 Drawing Sheets

WEIGHT LIFTING MACHINE

BACKGROUND OF THE INVENTION

The present invention relates to weight lifting machines and methods. More particularly, the present invention relates to novel weight lifting machines and methods particularly for working the leg muscles whereby the user may quickly change between any desired angular orientation of the units relative to the floor.

Weight lifting apparatus are found in most every gym today. Free weights (e.g., bar bells, dumb bells, kettle bells, etc.) allow a user to perform a weight lifting exercise in their own personal style. If performed incorrectly, the user may injure themselves and it is therefore important the user receive instructions in proper lifting techniques when using free weights. A spotter may also be necessary. Fearing injury through incorrect technique with free weights, many people choose to use weight lifting machines which are ergonomically designed to assist the user in performing the correct weight lifting movement with more control. In weight lifting machines, the user is directed to move a component which connects to the weight such that the user is not holding or touching the weight directly as they do with free weights. Furthermore, weight lifting machines typically incorporate a mechanism allowing the user to quickly and easily switch between different amounts of weights as desired.

Weight lifting machines come in many different styles that are typically designed to work a specific muscle or muscle group (e.g., ham strings, quadriceps for the legs, and triceps and biceps for the arms). For working the leg muscles, there is a machine known as the leg press. In the leg press, the user moves their legs and feet while maintaining their torso in a stationary position. The user sits on a stationary seat and, with legs initially bent, pushes their feet against a moveable plate which connects to the weights (e.g., weight stacks or plate loaded). The feet push the foot plate away from the user's body until their legs are substantially straight. This movement lifts the weights by using the leg muscles. The user then moves their legs back to the bent position while controlling the return speed of the foot plate which also works the leg muscles. The movement is then repeated several times.

Another type of machine for working the leg muscles is known as the hack squat. In this style of machine, the user moves their legs and torso while the feet remain stationary. The user stands on a stationary platform and starts in a position with the knees bent (a squatting position). A moveable, padded shoulder brace is connected to the weights and the brace is positioned directly above and touching the user's shoulders. The user then begins to straighten their legs (as one would do when moving from a squatting to a standing position) causing their shoulders to press against and lift the shoulder brace which hence also lifts the weights. Once the legs are substantially straight, the user squats down again while controlling the lowering of the weights via the shoulder brace, and repeats this movement several times.

In either machine described above, the user's body is at a fixed angle relative to the floor and the only custom adjustment available is the amount of weight being lifted and the ability to change the beginning angle of the legs by adjusting the distance between the foot plate/shoulder brace with the seat/platform, respectively. With the body always at the same angle relative to the floor, the same muscle fibers will be worked by an amount correlated to the selected amount of weight. Given the same machine and weight, changing the body angle relative to the floor will change the user's center of gravity which in turn will change the working dynamics of the leg muscles. It would therefore be desirable to have a leg press and hack squat where the user's body angle relative to the floor may be selectively changed as desired.

SUMMARY OF THE INVENTION

The present invention addresses the above need by providing a leg press and hack squat which are selectively adjustable to change the user's angle relative to the floor as desired.

In a first embodiment, the present invention provides a leg press machine which allows the user's body angle relative to the floor to be adjusted as desired. In a "linear frame" embodiment of the leg press, the present invention comprises a leg press machine having a leg press unit with a movable foot plate and seat mounted to the leg press unit. The foot plate, which can move relative to the seat (the foot plate and associate moving components commonly referred to as a "sled"), connects to the weights where the user can select the amount of weight to be used for a particular workout. In a 90° embodiment of the linear frame, the frame includes a pair of horizontal members connected to a pair of vertical members, respectively, each of which have tracks wherein wheels mounted to the unit may fit and slide back and forth therein. The forward part of the unit (toward the user's feet) faces the vertical frame members and is connected to a cable which may be adjusted (e.g., via a winch) to pull the forward end of the unit upwardly along the tracks of the vertical frame members. The rear end of the unit which includes the seat slides along the horizontal tracks toward the vertical tracks as the forward part of the unit rises along the vertical tracks. The user adjusts the cable until the desired height of the forward end of the unit is reached and then fixes the unit in the desired position (e.g., by locking the winch and/or inserting a removable pin through the frame and unit). In this way, the user may adjust the unit into various angular positions with respect to the floor to achieve the desired dynamic effect on the leg muscles during the work out. In another angled frame embodiment, the frame is formed with the nonhorizontal members extending at an obtuse angle relative to the horizontal members.

In another embodiment, the leg press includes an arc-shaped frame connected to the horizontal frame. The rear section of the unit is pivotally connected to the horizontal frame and is in a fixed position thereon, i.e., the unit may pivot but not slide forward and backward on the horizontal frame members as in the linear frame embodiment. The arcshaped frame extends upwardly and arcs back toward the rearward end of the unit such that the inner perimeter of the arc faces toward the user seated on the unit. At least one but preferably a pair of parallel, spaced arc frames are provided, one of which includes a cable connected to the forward end of the unit. The forward end of the unit includes a wheel or the like which is adapted to freely slide within a track of a respective arc frame. The user may adjust the cable (e.g., using a winch) to pull the forward end of the unit upwardly along the arc frame until the desired angle of the unit relative to the floor is reached. One or more pulleys may be provided along the arc frame around which the cable may extend to reduce the work needed to adjust the cable. Once the unit is in the desired angular position relative to the floor, the user fixes the position (e.g., by locking the winch and/or passing a removable pin through the unit and frame).

In yet a further embodiment, the present invention provides a hack squat machine which allows the user's body angle relative to the floor to be adjusted as desired. The hack squat includes a removable platform where the user places their feet when used at an angle other than 90°. A shoulder brace is connected to weight plates or a weight stack and may be moved relative to the platform (or ground) along a pair of parallel, spaced side rails which extend along either side of the user. In the 90° frame embodiment, the ends of the hack squat side rails located adjacent the floor or platform include wheels or the like which fit and slide within the tracks of the horizontal frame members. The opposite ends of the guide rails adjacent the shoulder brace include wheels or the like which fit and slide within the tracks of the vertical (or angled) frame members. Appropriate removable securing components are used to secure the hack squat in the desired angular position. In an arc frame embodiment of the hack squat, the end of the guide rails adjacent the platform are pivotally connected to the horizontal frame members and are in a pivotally fixed position, i.e., the hack squat may pivot but not slide forward and backward on the horizontal frame members as in the linear frame embodiment. The opposite ends of the guide rails include a wheel or the like which rides along the track of the arc frame such that the hack squat may be angularly adjusted relative to the floor in the same manner as the leg press as described above.

In yet a further embodiment, a frame is provided having telescoping horizontal frame members which may be selectively powered to alternately extend and retract as desired. The free ends of the moving telescoping members are connected to pivotable linkages to which the forward end of the unit (in the case of the leg press) or the guide rails (in the case of the hack squat) attach. When the telescoping frame members are in the fully retracted position, the forward end of the unit/hack squat is at its lowest position. As the telescoping frame members are extended, the linkages pivot to an angled position causing the forward end of the unit/hack squat to rise vertically relative to the rearward end of the leg press/hack squat. This movement changes the angle of the leg press/hack squat relative to the floor.

Using the inventive machine, a user may customize their leg press work out since leg press unit angles approaching 90° will work different quadriceps muscle fibers than leg press unit angles approaching 0° given the same weight load.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

Figure 6:
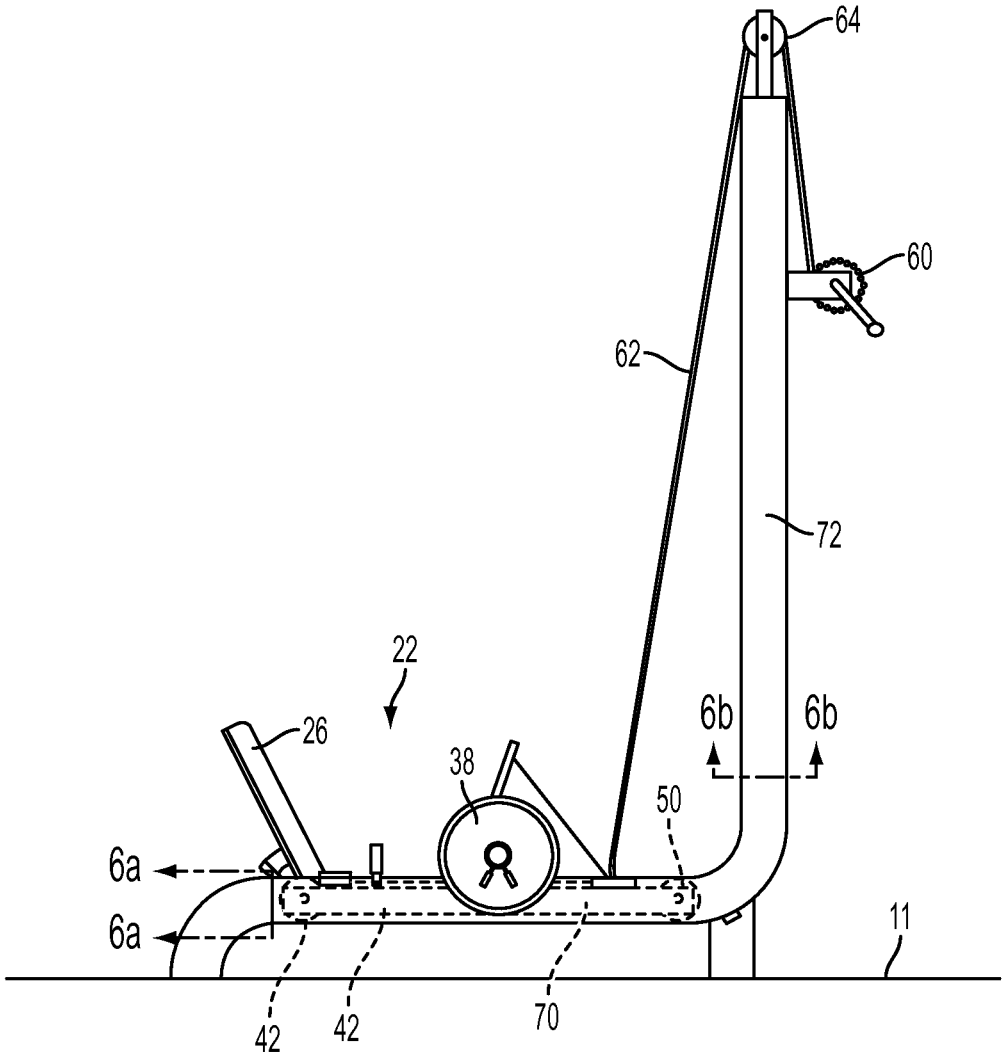
FIG. 6 is a side elevational view of a 90° frame leg press machine according to another embodiment of the invention.
Figure 6A:
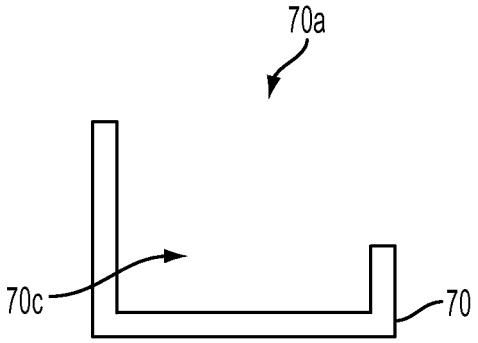
Figure 6B:
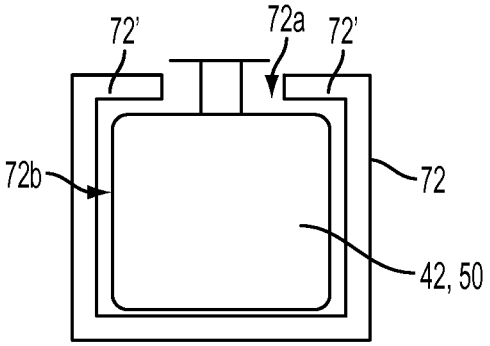
Figure 6C:
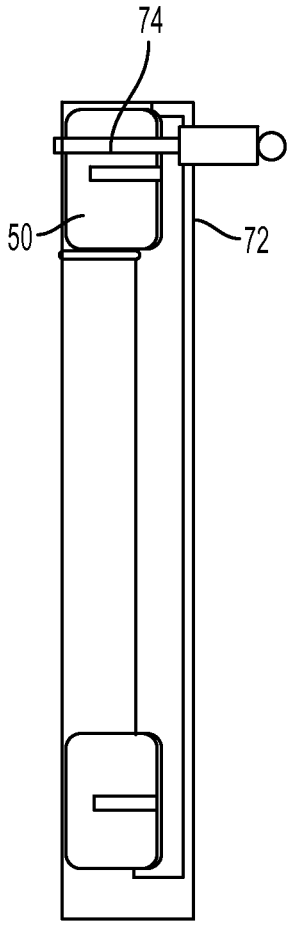
Figure 7:
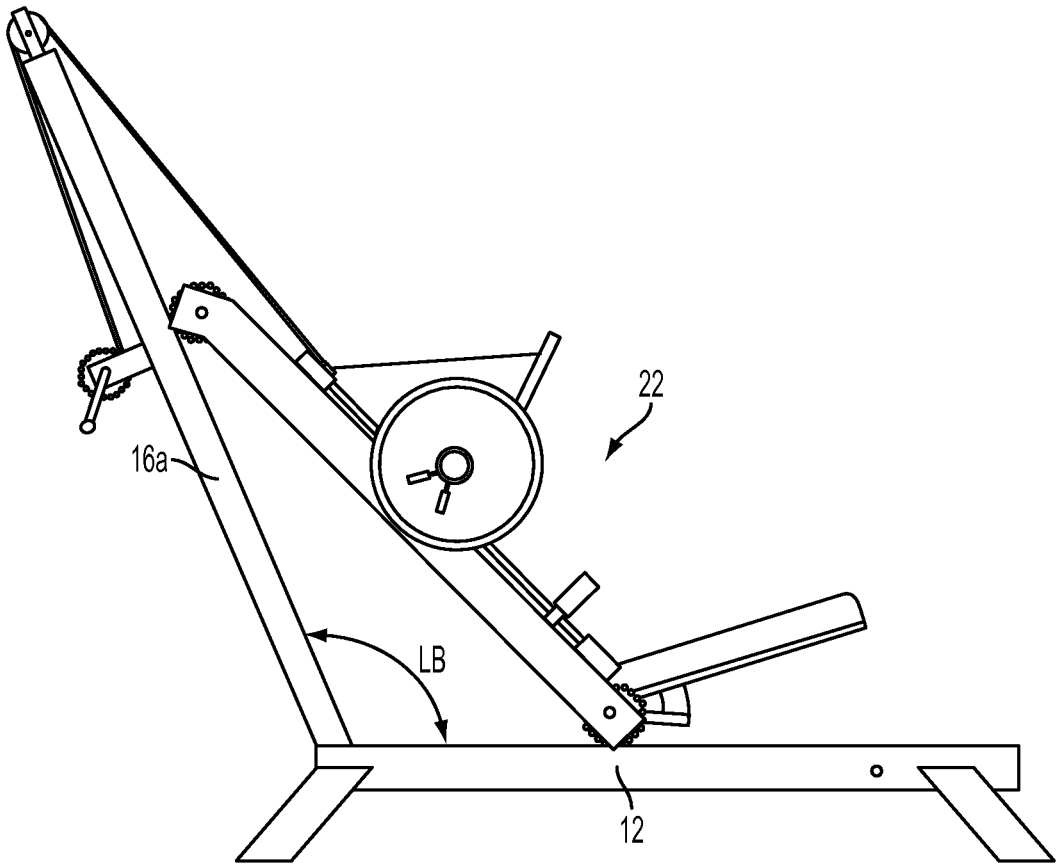
Figure 8:
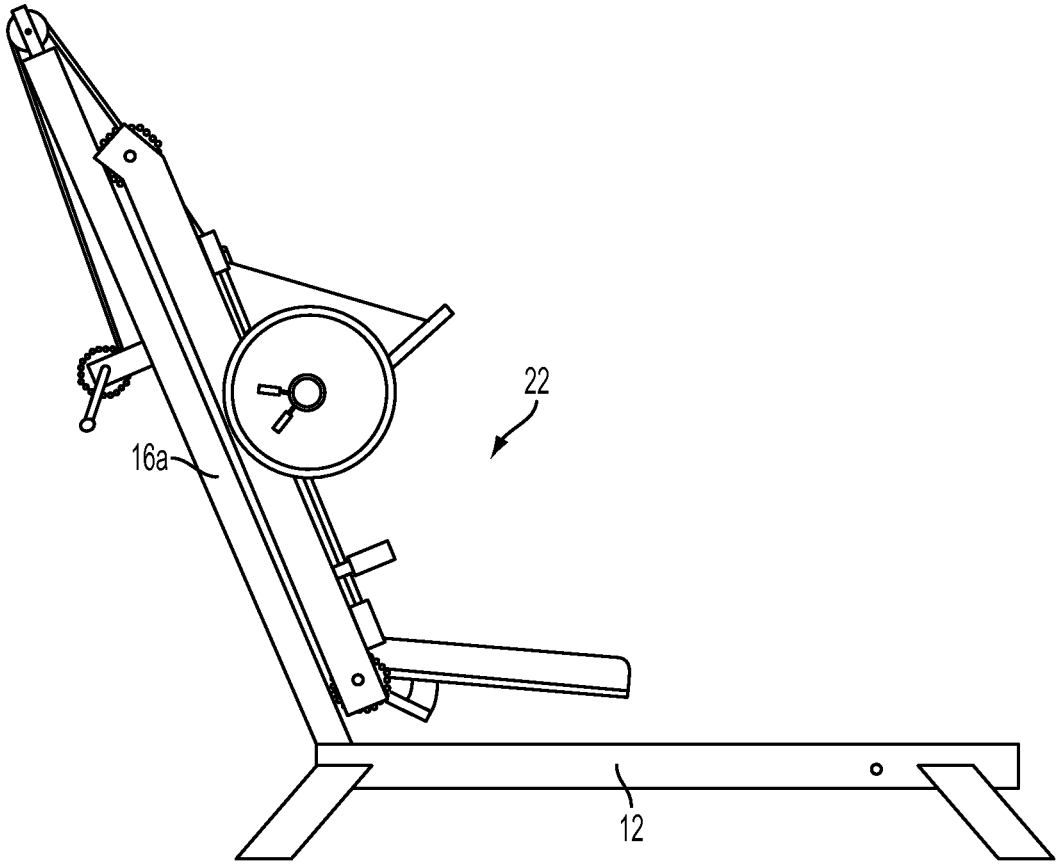
Figure 9:
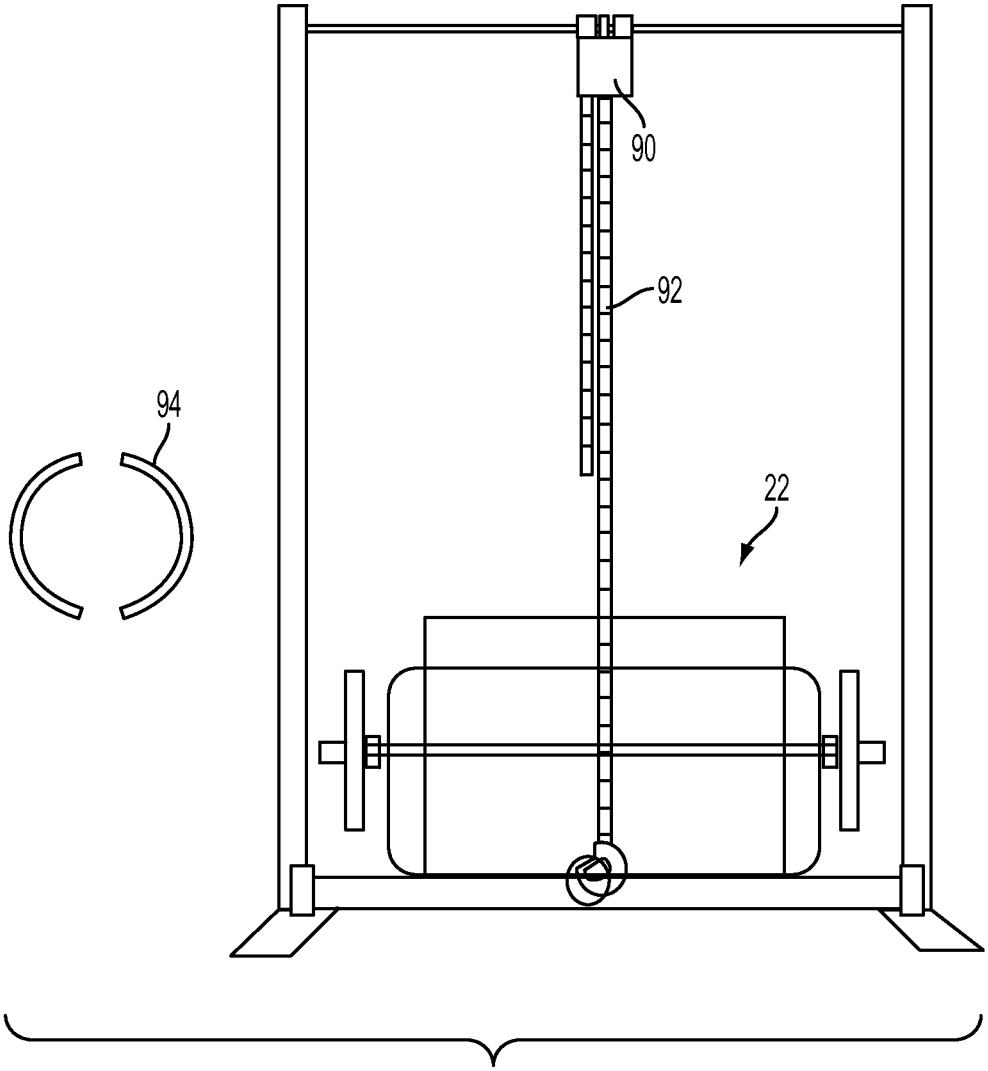
Figure 10:
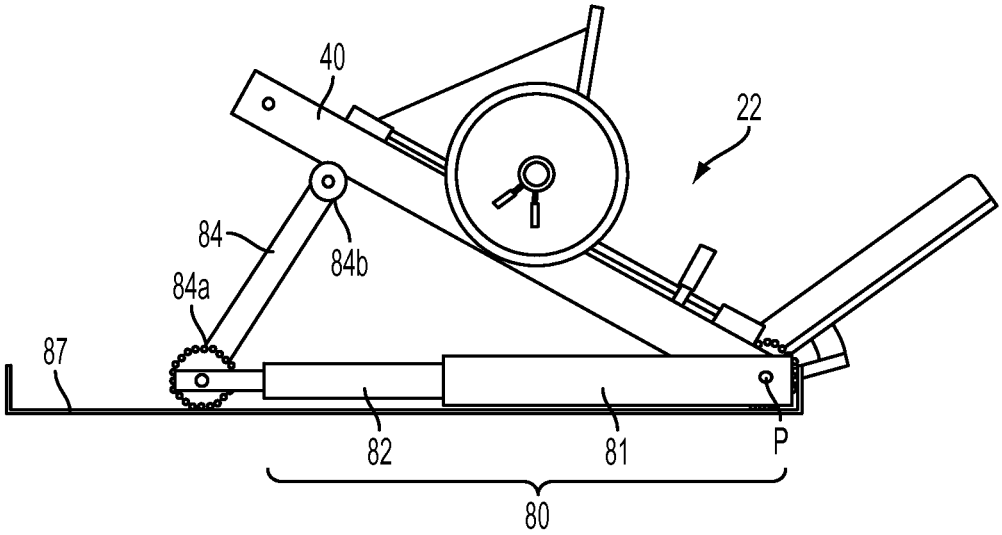
Figure 11A:
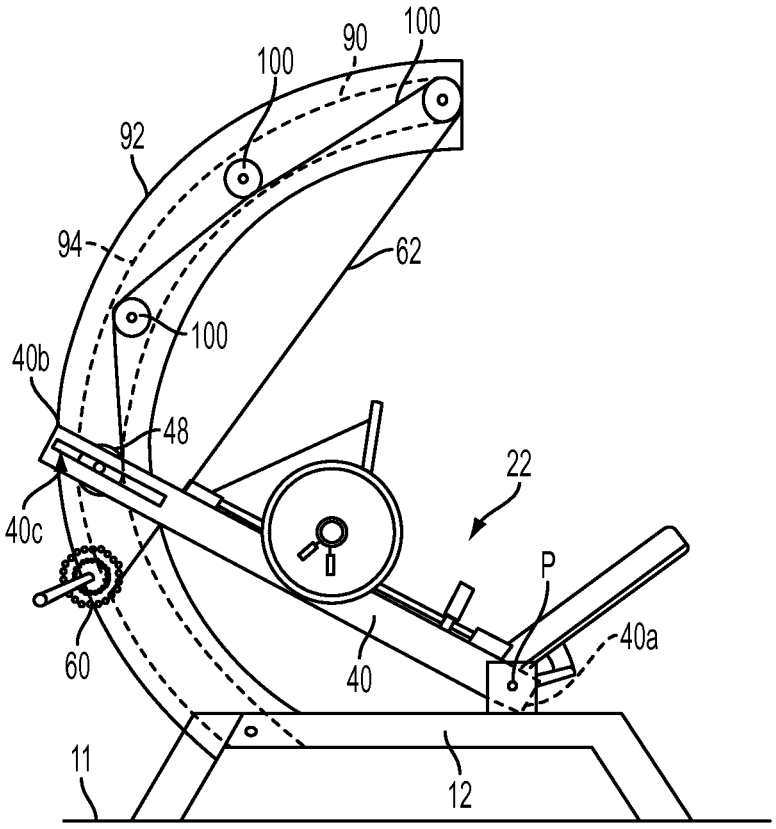
Figure 11B:
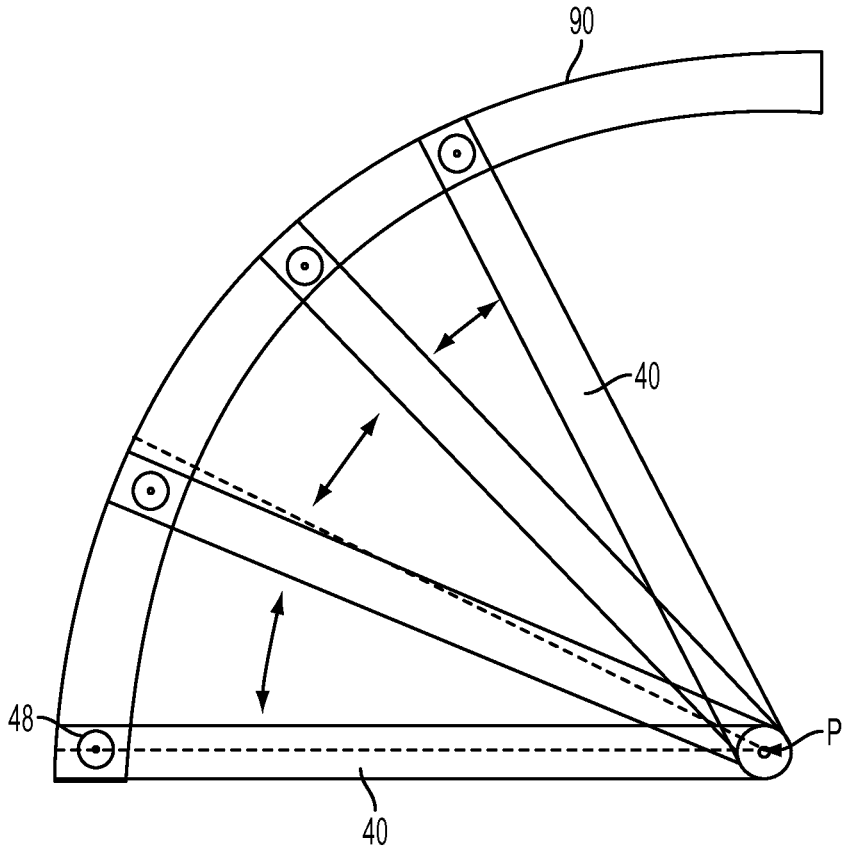

FIG. 6*a* is a cross-sectional view as taken along the line 6*a*-6*a* in FIG. 6;

FIG. 6*b* is a cross-sectional view as taken along the line 6*b*-6*b* in FIG. 6;

FIG. 6*c* is a simplified section view showing an embodiment of securing a movable frame to a stationary frame;

FIG. 7 is a side elevational view of 70° frame leg press machine according to another embodiment of the invention with the leg press unit shown at an angle to the floor;

FIG. 8 is the view of FIG. 7 showing the unit moved to a further angled position relative to the floor;

FIG. 9 is a front elevational view of the leg press machine showing an alternate leg press raising and lowering mechanism;

FIG. 10 is a side elevational view of another embodiment of the leg press machine having a telescoping powered lift mechanism;

FIG. 11*a* is a side elevational view of another embodiment of the leg press machine having an arc-shaped stationary frame;

FIG. 11*b* is a simplified schematic representation of an alternate embodiment of a circular quadrant shape for the arc-shaped frame of FIG. 11*a;*

Figure 11C:
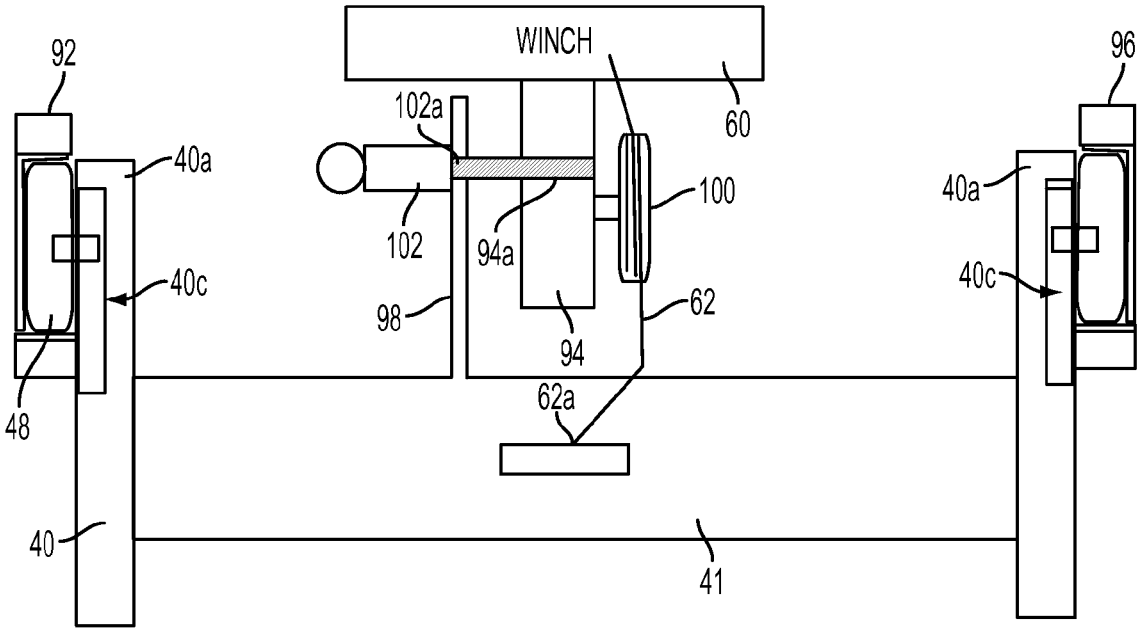

FIG. 11*c* is a simplified top plan view of FIG. 11*a;*

Figure 11D:
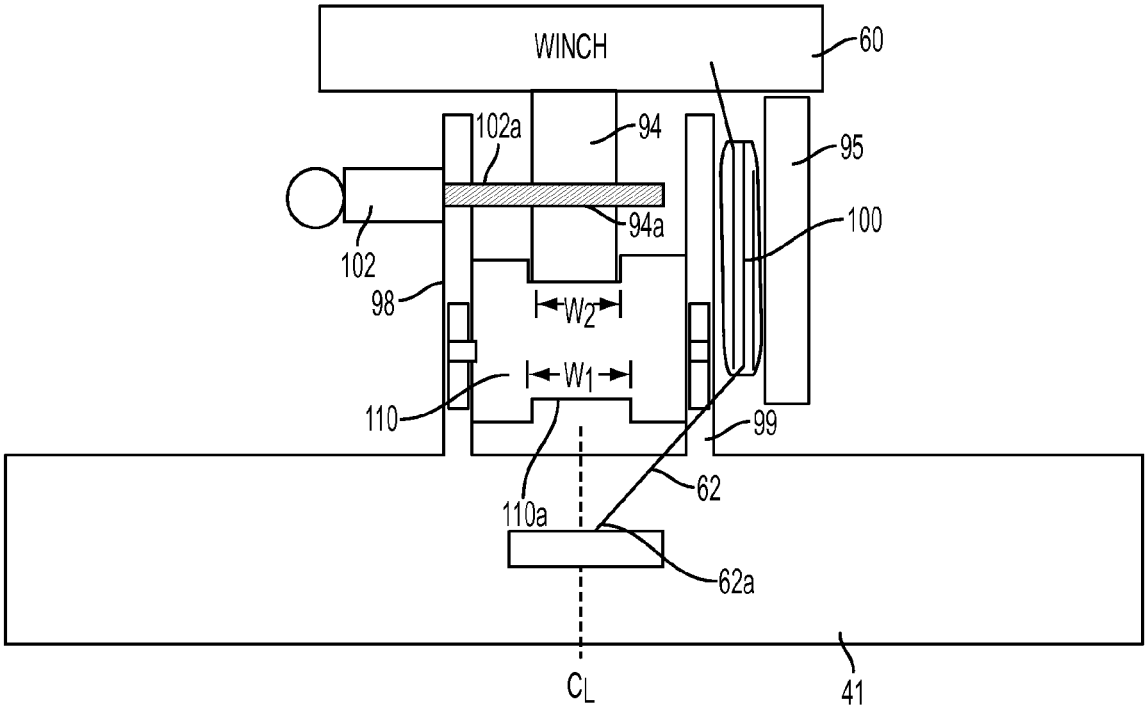

FIG. 11*d* is a simplified top plan view of a single arc embodiment of FIG. 11*a;*

Figure 12:
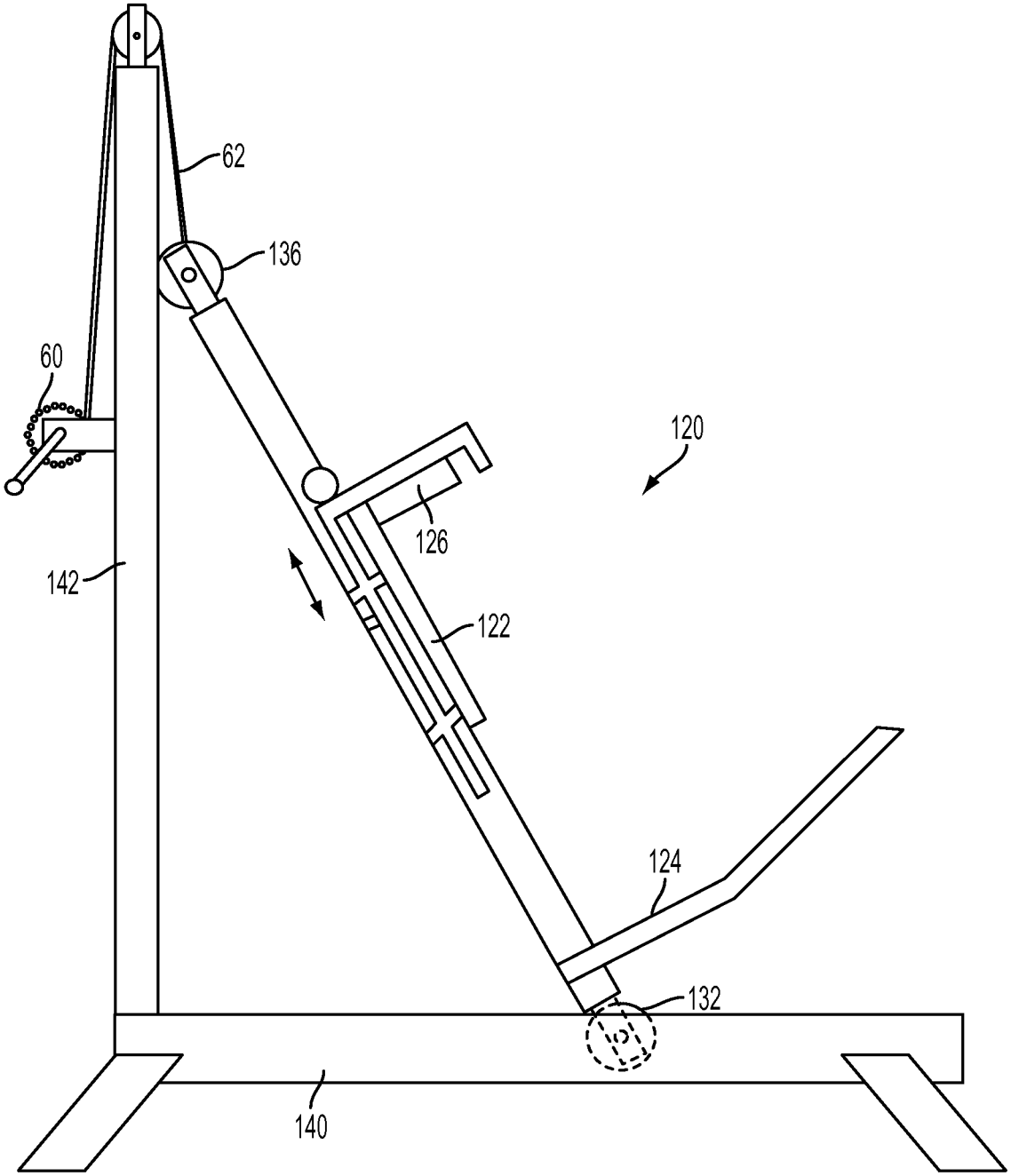
Figure 13:
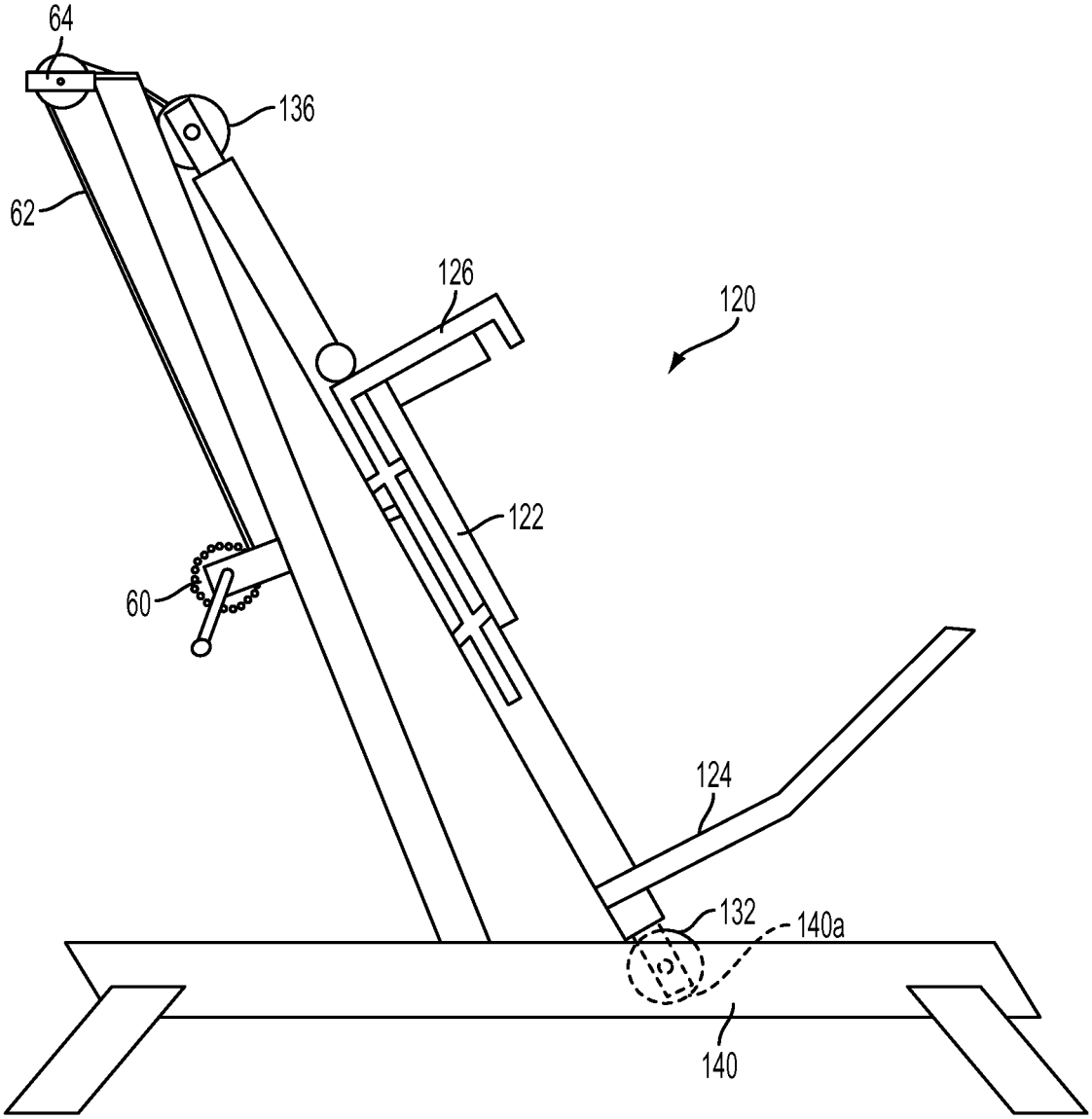
Figure 14:
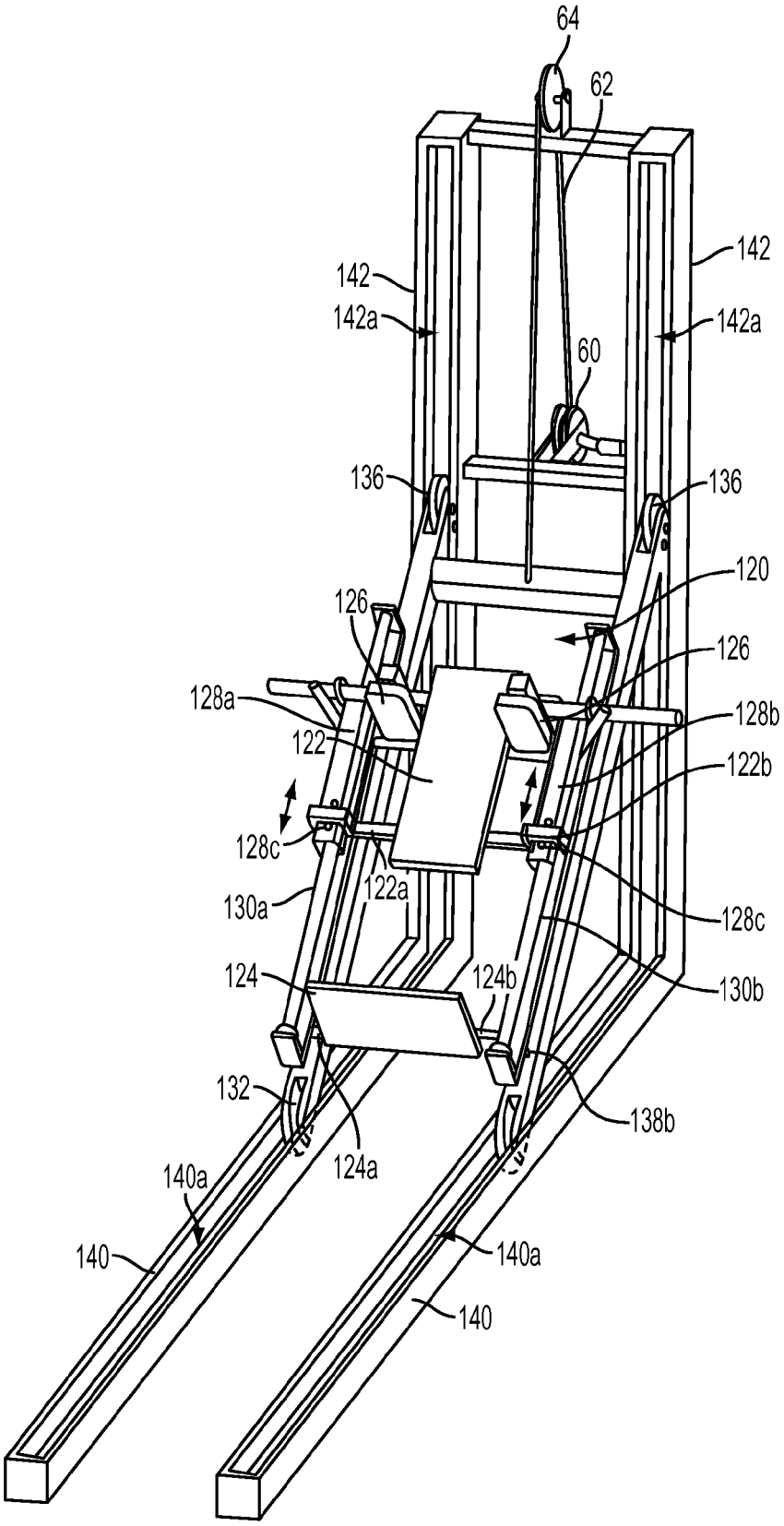
Figure 15:
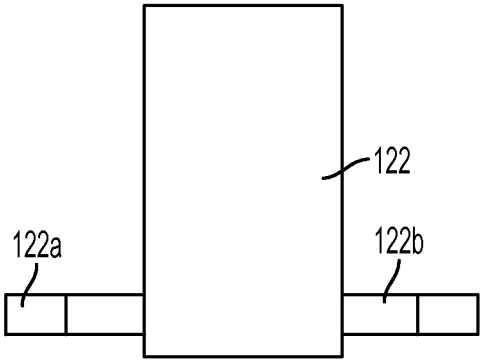
Figure 16:
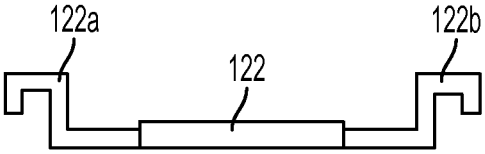
Figure 17:
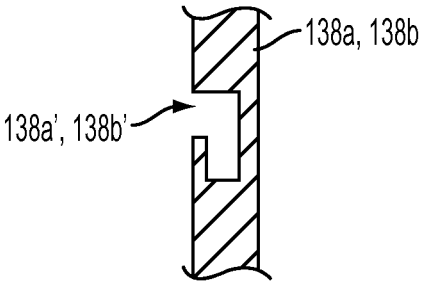
Figure 18:
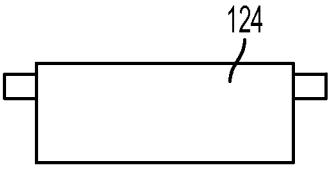
Figure 19:
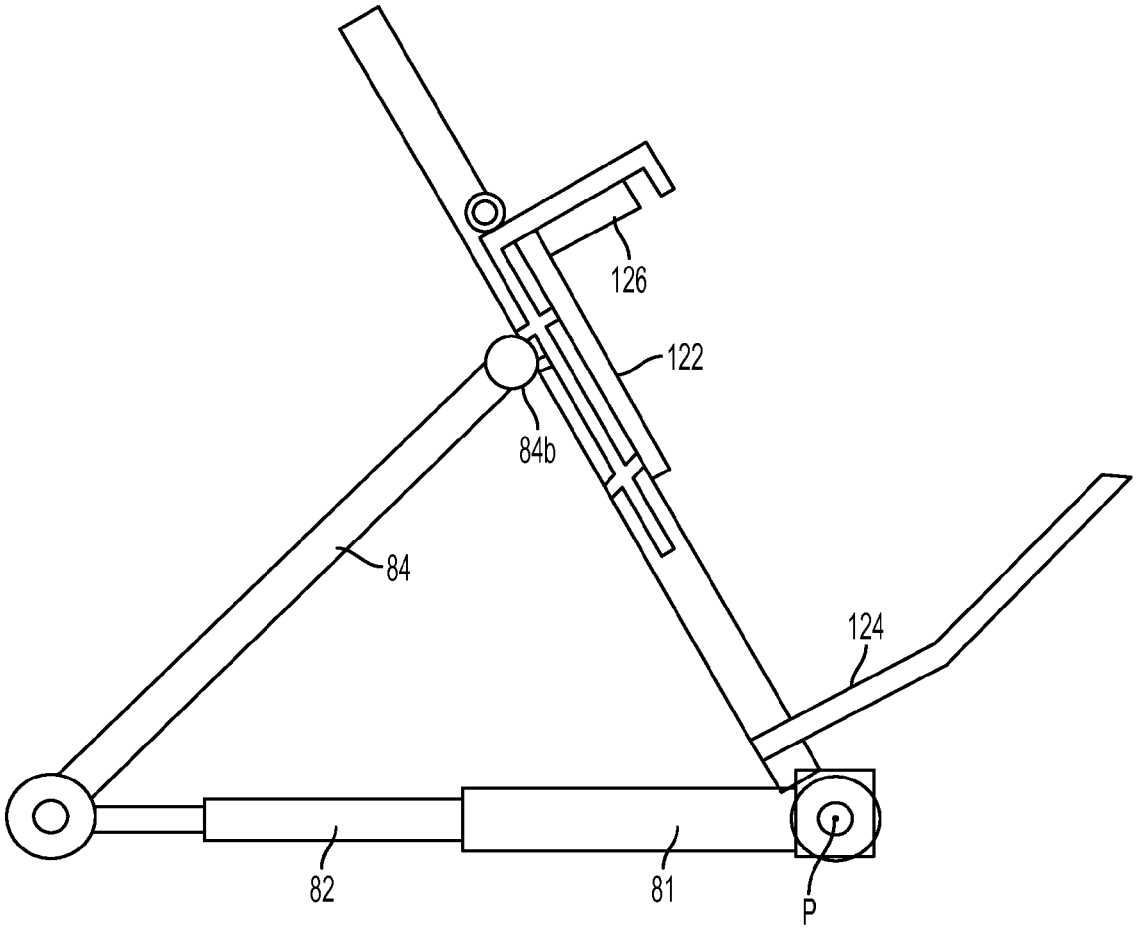
Figure 20:
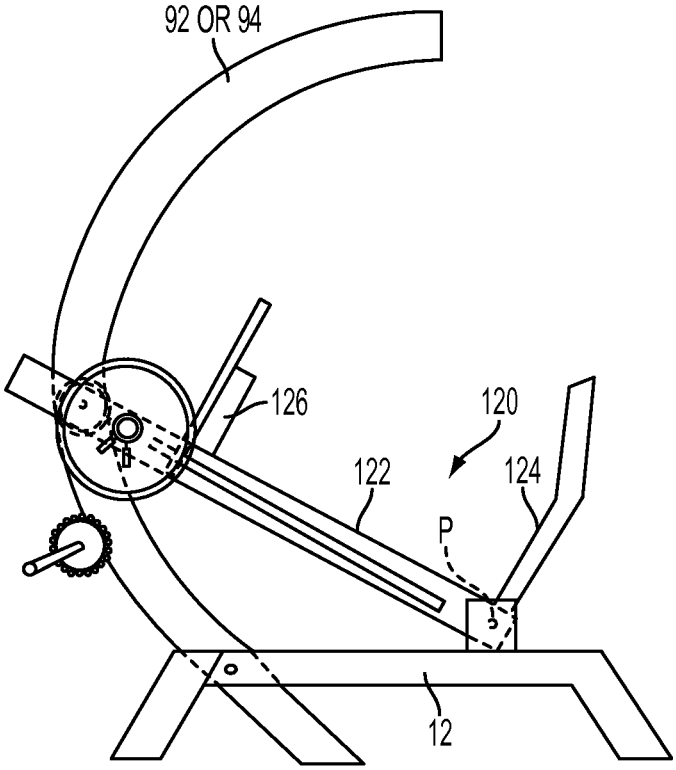

FIG. 12 is a side elevational view of a 90° hack squat machine according to another embodiment of the invention;

FIG. 13 is a side elevational view of 70° hack squat machine according to another embodiment of the invention with the hack squat unit shown at an angle to the floor;

FIG. 14 is a perspective view of the machine of FIG. 12 showing an alternate embodiment of stationary frame;

FIG. 15 is a top plan view of the removable back pad seen in FIG. 14;

FIG. 16 is an end view thereof;

FIG. 17 is a fragmented, cross-sectional view of the hack squat side frame showing the means for removable attachment of the foot plate;

FIG. 18 is a top plan view of the foot plate of FIG. 14;

FIG. 19 a side elevational view of another embodiment of the hack squat machine having a telescoping powered lift mechanism; and FIG. 20 is a side elevational view of another embodiment of the hack squat machine having an arc-shaped stationary frame.

DETAILED DESCRIPTION OF A PREFERRED EMBODIMENT

Referring to the drawing, there is seen in FIGS. 1-5 a first embodiment of the invention comprising a leg press machine denoted generally by the reference numeral 10. In this first embodiment of the invention, a 90° frame is provided having first and second, spaced and parallel horizontal frame members 12 and 14 which may be raised from floor 11 on legs 9*a*-9*d*. Horizontal frame members 12 and 14 connect to first and second vertical frame members 16 and 18, respectively. One or more cross members 20*a*, 20*b* may interconnect vertical frame members 16 and 18 to increase the stability thereof, and one or more cross members 13 (see FIG. 4) may interconnect horizontal frame members 12 and 14 to increase the stability thereof.

A leg press unit 22 is provided having a seat 24 with back rest 26 and a sled comprising a foot plate 28 mounted to and between a pair of spaced support plates 30 and 32 which are in turn mounted to a cross member 31 having opposite ends 31*a* and 31*b* which may freely slide back and forth along a pair of respective rails 33*a* and 33*b*. A pair of weight plates 36, 38 may be removably mounted to a cross bar 34 extending between support plates 36 and 38. In an alternative embodiment, rather than loaded weight plates, foot plate 28 may connect via cables (not shown) to a conventional weight stack 34 (see FIG. 1). An elastic band 35 connects cross bar 34 to frame segment 12 such that foot plate 28 is biased in the retracted "at rest" position (closest to seat 24).

Unit 22 is mounted upon a pair of spaced, parallel unit frame members 40 and 42 having a pair of rear wheels 44, 46 and a pair of front wheels 48, 50 that may roll back and forth along tracks 52, 54 which are mounted to frame members 12, 14, respectively. Vertical frame members 16, 18 also include respective tracks 56, 58 along which unit front wheels 48, 50 may roll as described more fully below.

Figure 1:
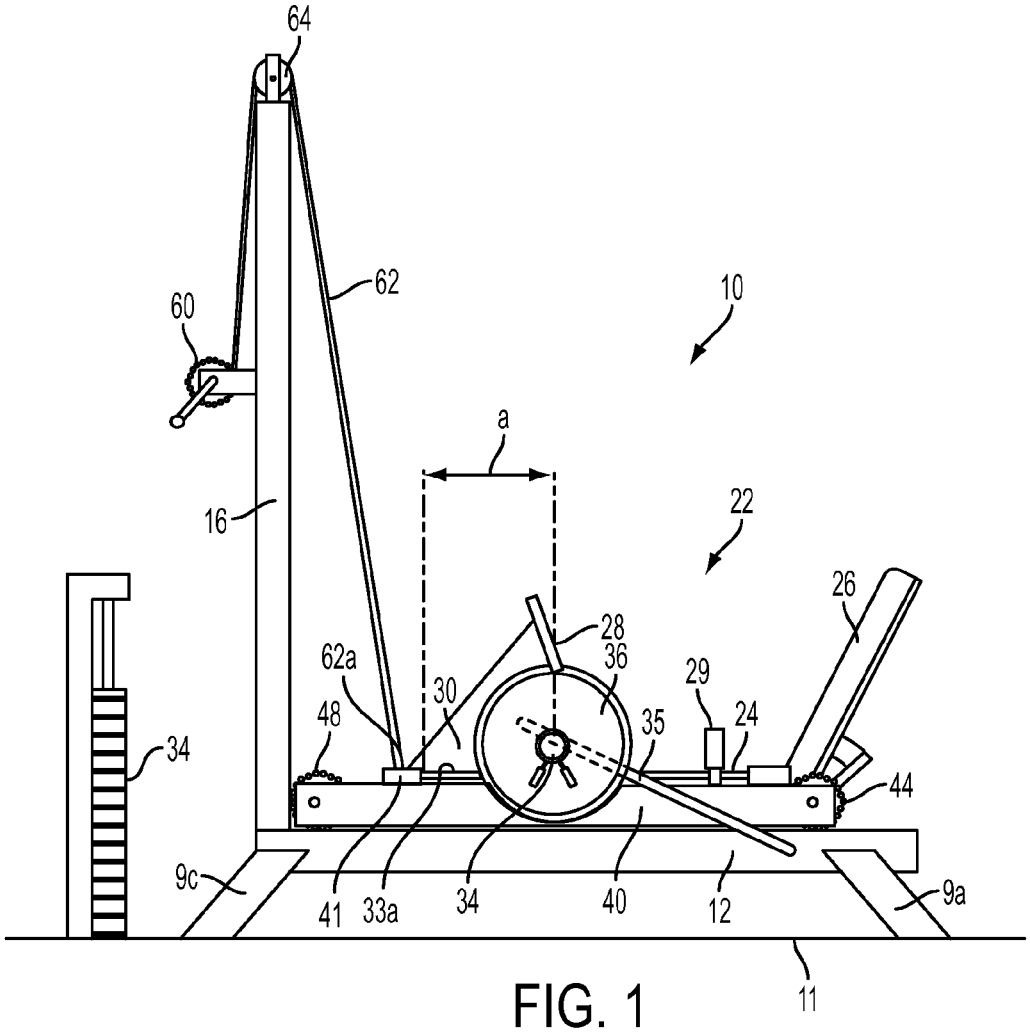
FIG. 1 is a side elevational view of a 90° frame leg press machine according to an embodiment of the invention.

Referring to FIG. 1, a user performs a leg press by sitting on seat 24 with their back resting against back rest 26 with the user's feet placed against foot plate 28. The distance between the fully retracted (at rest) foot plate 28 and seat 24 may be selectively adjusted via a manually operable releasable locking rod 29 such that when at rest, the seated user's legs, with feet resting on foot plate 28, are bent at the desired angle. Releasable locking rod 29 operates in the same manner as found on present day (prior art) leg press machines and the details thereof will therefore not be discussed here. The user performs the work out by extending their legs from the bent position while pressing their feet against foot plate 28 whereby plate 28, along with weight plates 36 and 38, are pushed away from seat 24 by riding along rails 33*a* and 33*b*. The legs are thus used to move the weight attached to the foot plate which works the leg muscles as intended.

It will be appreciated that as the foot plate 28 is moved away from the stationary seat 24, band 35 stretches and is in tension. When the legs are substantially straightened, the foot plate 28 has traveled a distance represented by arrow "a" in FIG. 1. In this extended position of foot plate 28, band 35 is stretched and biases foot plate 28 in the opposite direction, i.e., toward the retracted position. Thus, as the user slowly retracts their legs back to the angled position, they must use their leg muscles again to control the speed of the foot plate which is being pulled by band 35. The user may then repeat the leg extension and retraction movement several times.

Figure 2:
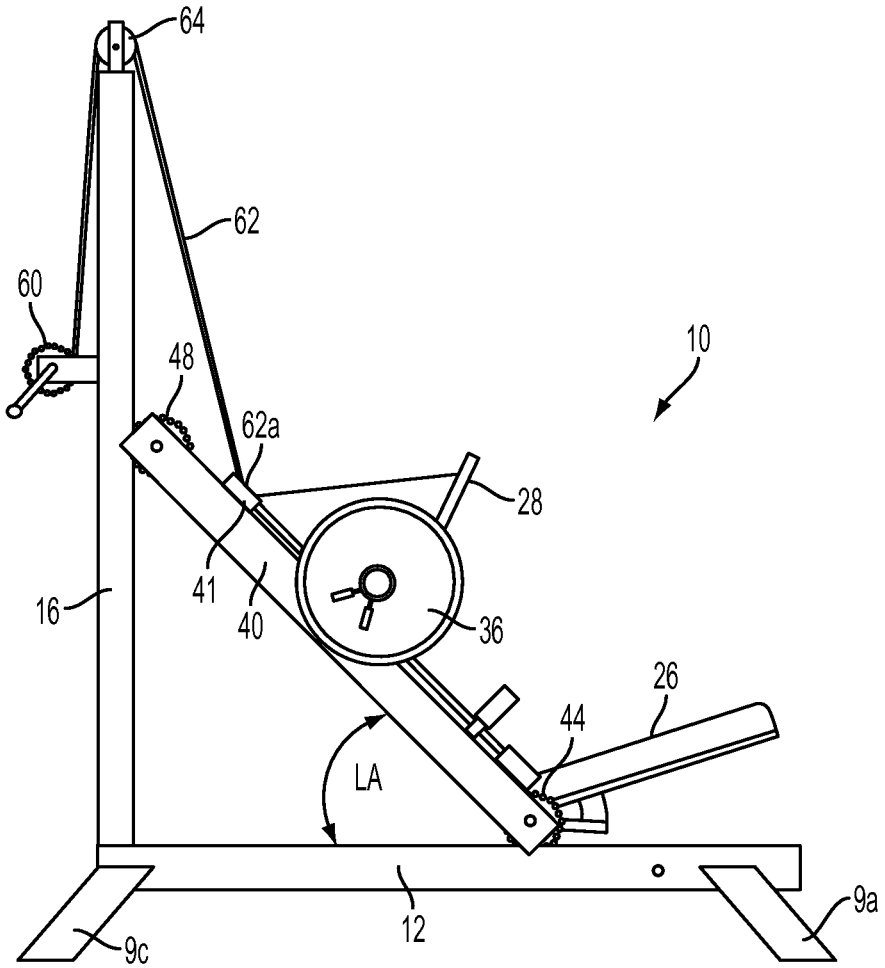
FIG. 2 is the view of FIG. 1 showing the unit moved to an angled position of approximately 60° relative to the floor.
Figure 3:
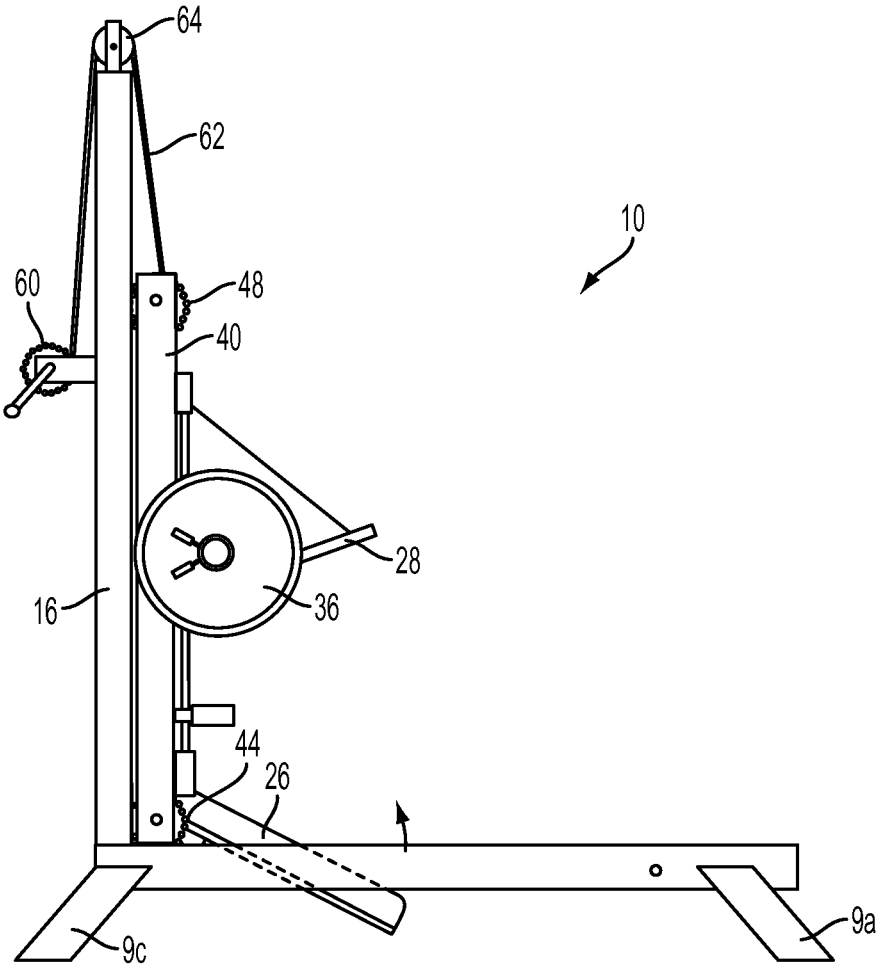
FIG. 3 is the view of FIGS. 1 and 2 showing the unit moved to an angled position of approximately 90° relative to the floor.
Figure 4:
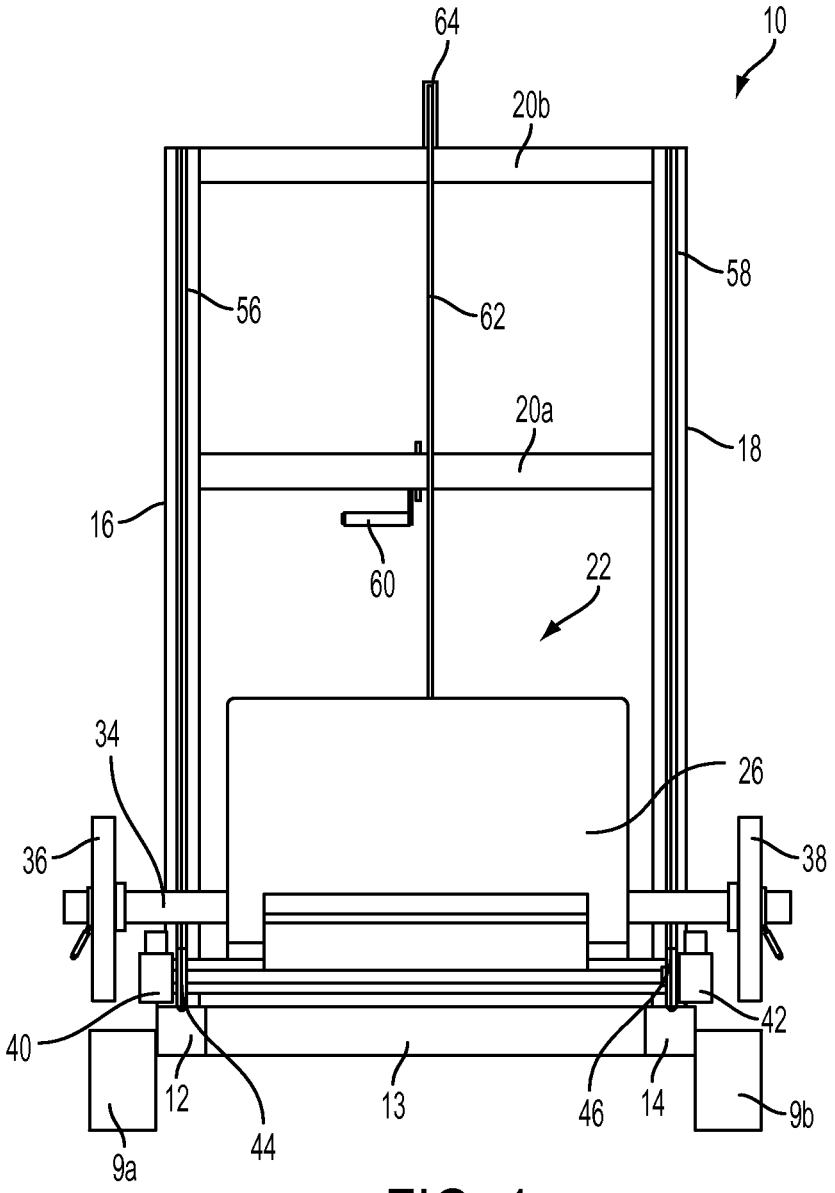
FIG. 4 is a front elevational view of FIG. 1.
Figure 5:
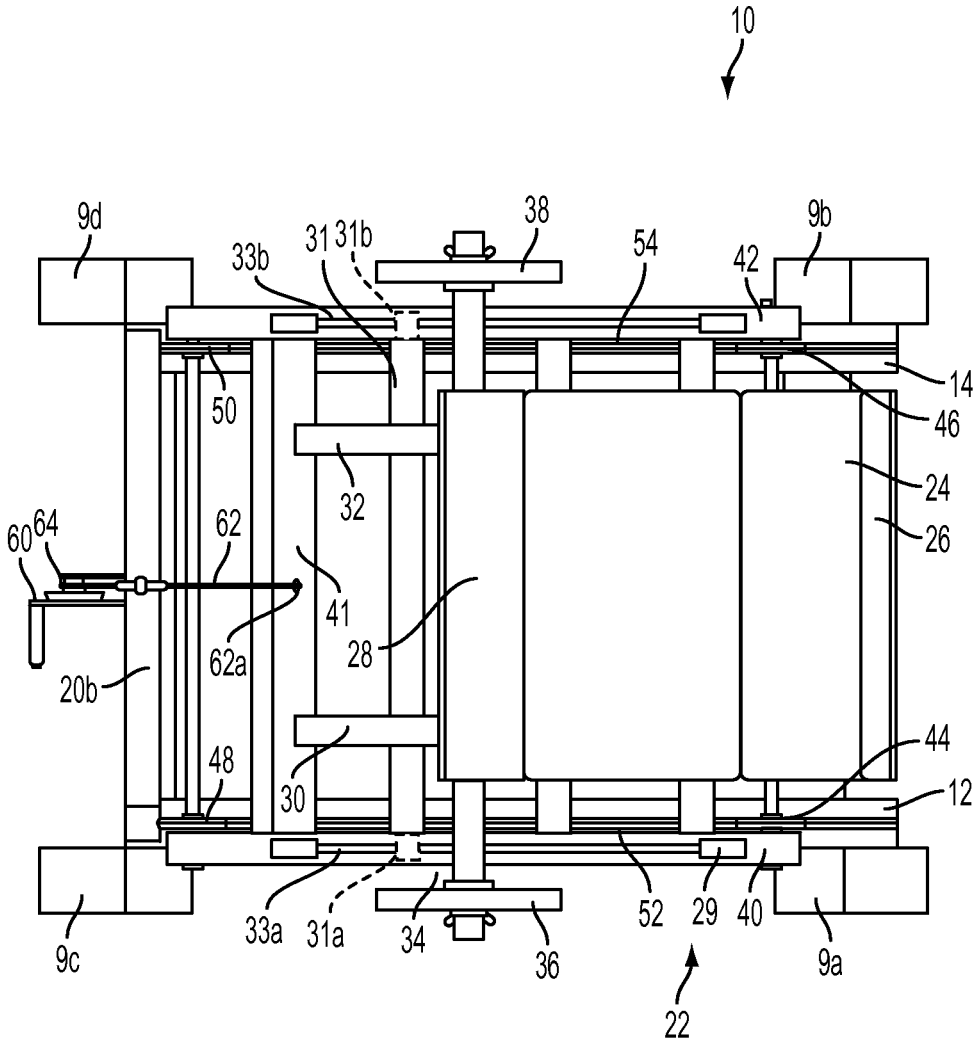
FIG. 5 is a top plan view thereof.

FIG. 1 illustrates leg press 10 with unit 22 at zero degrees, i.e., in the horizontal position which is parallel to frame members 12, 14 and to the floor 11. FIG. 2 illustrates leg press 10 with unit 22 at an angle "A" relative to the horizontal frame members 12, 14 and floor 11. FIG. 3 illustrates leg press 10 with unit 22 at a ninety degree right angle relative to the horizontal frame members 12, 14 and floor 11. The user may move unit 22 into any desired angle between zero and ninety degrees by turning winch 60 connected to cable 62 which connects to unit cross member 41 at cable end 62*a*. As seen best in FIG. 4, in the preferred embodiment, winch 60 mounts to cross member 20*a* and pulley 64 mounts to cross member 64 with cable 62 directed over pulley 64. Any suitable mechanism may be used to lock unit 22 in the desired angular position. For example, winch 60 may be of the releasable locking type allowing the user to lock winch 60 when unit 22 is at the desired angle. Removable pins that extend through the frame and unit frame and/or wheels may also be used to the lock the unit in the desired angular position as described more fully below.

As unit 22 is raised from the horizontal position to an angled position such as seen in FIG. 2, front wheels 48 and 50 ride tracks 56, 58 along vertical frame members 16, 18, respectively, with simultaneous riding of rear wheels 44, 46 in tracks 52, 54 of horizontal frame members 12, 14, respectively. It will thus be appreciated a user may thereby customize their leg press work out since unit angles approaching 90° will work different quadriceps muscle fibers than unit angles approaching 0° (zero degrees) given the same weight load as explained above.

FIG. 6 illustrates another embodiment of the 90° frame leg press of FIGS. 1-5 wherein the horizontal and vertical frame members 70, 72, respectively, are formed with channels wherein the wheels 44, 46 and 48, 50 may be inserted and travel back and forth therein. Although only one side of the leg press in shown in this embodiment, it is of course understood that the opposite side and other unseen elements are the same as those shown and described with reference to the embodiment of FIGS. 1-5.

Horizontal frame member 70 may be U-shaped having an opening 70*a* as seen in FIG. 7 wherethrough the wheels may be dropped into frame channel 70*c*. Opening 70*a* may or may not extend the full length of horizontal frame member 70. With opening 70*a* facing upwardly, the unit wheels will seat in the bottom of the channel due to gravity and remain within channel 70*c* until lifted back out through opening 70*a*. Since the vertical frame member 72 cannot rely on gravity to maintain the wheels within its channel 72*c*, flanges 72' are provided which narrow opening 72*a* to prevent the unit wheels from disengaging therefrom.

As seen in FIG. 6*a*, horizontal and vertical frame members 70, 72 may be formed from a single piece of material if desired. Unit 22 may be moved to any desired angular position and locked in place in the same manner as described with reference to the embodiment of FIGS. 1-5. Any mechanism may be used to releasably lock the unit in the desired position such as a locking winch. As seen in FIG. 6*c*, removable pins 74 that extend through the frame 72 and unit frame and/or wheels such as wheel 50 may also be used to the lock the unit in the desired angular position.

FIGS. 7 and 8 illustrate another embodiment of the leg press frame with movable unit 22 wherein the vertical frame 16*a* is at an obtuse angle "b" relative to the horizontal frame member 12. Angle b may be any obtuse angle between 90° and 180° and is illustrated at an approximately 115° angle. All other elements of this embodiment are the same as in the embodiment of FIGS. 1-5. It is understood that the frame configuration of FIG. 6 may also be utilized if desired in this embodiment.

FIG. 9 illustrates a chain hoist mechanism 90 which may be used to alternately raise and lower unit 22 as an alternative to the winch 60 and cable 62. Chain 92 may be guided inside an open channeled tube frame 94 to protect the chain and prevent or lessen the chance of injury to the user. Other mechanisms which may function for alternately raising and lowering leg press unit 22 may be used as desired.

FIG. 10 illustrates yet a further, powered embodiment of the leg press wherein leg press unit 22 is mounted to a pair of parallel, spaced linear actuators 80 (only a single actuator 80 seen in FIG. 10) which may be selectively powered via a power source (not shown) to alternately extend and retract rod 82 within cylinder 81 as desired. The free end of the rod 82 is pivotably connected to a first end 84*a* of a linkage arm 84, and the second, opposite end 84*b* is pivotably connected to unit frame member 40 adjacent the forward end thereof. FIG. 10 shows linear actuator 80 with rod 82 in the fully extended position (arm 84 has pivoted clockwise to reach the position in FIG. 10). In this position, arm 84 is angled toward actuator 80 and unit 22 is raised to an angular position. When the linear actuator 80 is moved toward the retracted position, arm 84 pivots in the opposite direction and the forward end of the unit will rise slightly (until arm 84 is vertical) and then begin to lower. A wheel 85 is provided at arm end 84*a* such that it may roll back and forth on the floor (or a safety platform 87) as the rod 82 extends and retracts. This movement changes the angle of the leg press relative to the floor as desired.

FIG. 11*a* illustrates yet another embodiment having a pair of curved frame members 92 mounted to horizontal frame members 12 and 14, respectively. Frame 92 may be in any desired curved shape although either an elliptical shape (FIG.

11*a*) or circular shape (FIG. 11*b*) is preferred. In the embodiment of FIG. 11*a*, frame end 40*a* of leg press unit 22 is pivotally connected to horizontal frame member 12 at pivot point P. Opposite frame end 40*b* lies adjacent to and may be selectively raised and lowered along curved frame 92 to set leg press unit 22 at any desired angular position between 0° and approximately 90° relative to the floor 11. Since frame 92 does not have a constant radius, as frame 40 is raised via winch 60 and cable 62, wheel 48 will be urged in a direction away from frame end 40*a*. To accommodate this force, a longitudinally extending slot 40*c* is formed in frame end 40*b* wherein the axle 48*a* of wheel 48 may travel back and forth. Suitable axle connectors (e.g., bushings and/or bearings—not shown) allow wheel axle 48*a* to freely move back and forth within slot 40*c* in direct response to the forces imparted on wheel axle 48*a* by the changing radius of frame 90 as wheel 48 travels therealong.

At least one, but preferably two or more pulleys 100 may be provided along an arc-shaped center frame 94 (see also FIG. 11*c*) to direct cable 62 therealong and provide mechanical advantage to reduce the force required to turn the winch. At least one curved frame 94 is provided although any number of frames may be utilized in parallel, spaced relation as desired. The fragmented, simplified plan view of FIG. 11*c* illustrates a three frame embodiment where the three curved frames are indicated by reference numerals 92, 94 and 96 where the center frame 94 includes the winch 60, cable 62 and one or more pulleys 100 about which cable 62 is directed and connects to cross member 41 at cable end 62*a*. Outer frames 92 and 96 may be configured with a C-shaped cross-section and track wherein the leg press unit front wheels 48 and 50 may be guided as the leg press unit is being alternately raised and lowered as described above. A plate 98 may be connected to cross member 41 to provide an anchoring point for releasably securing leg press unit 22 to frame 94 in the desired angular position. In this regard, a removable pin 102 may be used which the user passes through aligned holes 102*a* and 94*a* formed in plate 98 and frame 94, respectively. Any number of holes 94*a* may be formed along frame 94 to allow the user to select a hole 94*a* closest to the desired angular position of leg press unit 22.

FIG. 11*d* illustrates another embodiment having a single main curved frame 94 although a second (or more) curved frame 95 may be provided in parallel, spaced relation thereto and to which one or more pulleys 100 may be mounted. Second frame 95 may be omitted if not needed, for example, pulleys 100 may instead be mounted to brackets (not shown) connected to main frame 94 so long as they do not interfere with the raising or lowering of leg press unit 22. A single wheel 110 is rotatably mounted between a pair of parallel, spaced plates 98 and 99 which are connected to and extend from leg press unit cross member 41 on either side of and substantially equal distances from substantially the center line $C_L$ thereof. Wheel 110 may include a center groove 110*a* having a width $W_1$ which is slightly larger than the width W2 of frame 94 such that frame 94 tracks within groove 110*a* as wheel 110 rides along frame 94 during the raising or lowering of leg press unit 22 via operation of winch 60 and cable 62. Of course the opposite configuration may also be used wherein the wheel tracks inside a groove traversing the frame.

FIGS. 12-20 illustrate a hack squat unit 120 utilized with the same or similar embodiments of stationary frames shown in FIGS. 1-11 and discussed above, allowing the hack squat unit 120 to be selectively moved by a user to the desired angular position with respect to the floor. In the preferred embodiment, the hack squat unit 120 includes a removable back pad 122 and a removable foot plate 124. A pair of shoulder braces 126 are provided that connect to movable side frames 128*a* and 128*b* which may slide back and forth along respective guide rails 130*a* and 130*b* as in conventional hack squat machinery. The shoulder braces 126 are connected to weight plates or a weight stack (not shown). The user starts in a squatting position with the shoulder braces resting above and against the user's shoulders. As the user begins to straighten their legs to a standing position, they push their shoulders against the shoulder braces 126 thereby lifting them and the frames 128*a*, 128*b* upwardly against the force of the weights. The user returns to a squatting position and repeats the movement several times.

FIGS. 12 and 14 illustrate hack squat unit 120 on a 90° stationary frame having horizontal and vertical frame members 140 and 142 having tracks 140*a*, 142*b*, respectively, wherein wheels 132, 136 may ride back and forth. The user may removably secure the hack squat unit to the stationary frame in any desired angular position relative to the floor by utilizing, for example, a pin through one or more wheels or a lockable winch, for example.

Referring still to FIG. 14, as noted above, back pad 122 and foot plate 124 are removable. When a user wants to perform a standing squat (with hack squat unit 120 in a vertical standing position—not shown), the user may remove the back pad 122 and foot plate 124 so that they can stand on the floor and not be restricted by the back pad in moving their torso rearwardly. Removable securing means for the back pad may be provided in the form of angled brackets 122*a* and 122*b* on back pad 122 (see also FIGS. 15 and 16) which may be seated over respective frames 128*a* and 128*b*. Bolt heads 128*c* further secure brackets 122*a*, 122*b* to frames 128*a*, 128*b*, respectively.

Removable securing means for foot plate 124 may take the form of square stock elements 124*a* and 124*b* which may be removably secured into drop channels 138*a*', 138*b*' formed in main frame segments 138*a*, 138*b*, respectively.

FIG. 13 illustrates hack squat unit 120 on a 70° frame similar to frame in FIG. 7, FIG. 19 illustrates hack squat unit on a powered telescoping frame similar to frame 80 in FIG. 10, and FIG. 20 illustrates hack squat unit 120 on an arc-shaped frame similar to the frame in FIG. 11*a*. It is noted that these respective stationary frames (the 90° frame, the 70° frame and the arc-shaped frames) whether shown with a leg press unit or with a hack squat unit, are all similar in form and how they interact with the leg press unit and hack squat unit such that discussion of one frame type with relation to the leg press unit generally applies to the hack squat unit with respect to that same frame type as well.

While this method and apparatus has been shown and described with reference to certain preferred embodiments thereof, it will be understood by those skilled in the art that various changes in form and details may be made therein without departing from the spirit and scope of the invention as described.

What is claimed is:

1. A leg press machine, comprising:

a) a frame having first and second spaced and parallel horizontal frame members attached to respective first and second spaced and parallel arced frame members;

b) a leg press unit having a seat and a sled mounted to first and second, spaced, parallel rails, said sled having a foot plate, said foot plate being selectively movable in a reciprocating, sliding movement away and toward said seat by a user sitting in said seat with the user's feet pressed against said foot plate;

whereby said leg press unit is selectively movable and lockable between a horizontal and vertical position relative to said horizontal frame members, said leg press unit having a back end adjacent said seat which is pivotally connected to said first and second horizontal frame members, and a front end adjacent said foot plate which slides along said first and second arced frame members as said leg press unit is being moved from said horizontal position toward said vertical position.

* * * * *